United States Patent [19]

Anhalt et al.

[11] 3,982,807

[45] Sept. 28, 1976

[54] ZERO FORCE PRINTED CIRCUIT BOARD CONNECTOR

[75] Inventors: John W. Anhalt, Orange; James H. Curley, Costa Mesa, both of Calif.

[73] Assignee: International Telephone and Telegraph Corporation, New York, N.Y.

[22] Filed: Mar. 27, 1975

[21] Appl. No.: 562,552

[52] U.S. Cl. ..... 339/75 MP; 339/91 R; 339/176 MP

[51] Int. Cl.[2] ..... H01R 13/54

[58] Field of Search ..... 339/17 L, 74, 75, 176, 339/91

[56] References Cited

UNITED STATES PATENTS

| | | | |
|---|---|---|---|
| 3,474,387 | 10/1969 | Krum et al. | 339/75 MP |
| 3,573,706 | 4/1971 | Haberlen | 339/91 R |
| 3,587,031 | 6/1971 | Flavin et al. | 339/75 MP |
| 3,697,929 | 10/1972 | Konewko et al. | 339/75 MP |

OTHER PUBLICATIONS

IBM Technical Disclosure Bulletin, vol. 10, No. 11, 4/1968, p. 1695, Schmieg et al.

*Primary Examiner*—Roy Lake
*Assistant Examiner*—Neil Abrams
*Attorney, Agent, or Firm*—Thomas L. Peterson

[57] ABSTRACT

A zero insertion force printed circuit board connector in which two rows of resilient contacts are mounted on opposite sides of a printed circuit board receiving slot in a connector housing. The upper ends of the contacts are inclined toward each other. The connector housing is movable downwardly over the contacts to cam them into engagement with a printed circuit board mounted in the slot. A longitudinally extending rotatable cam is provided for shifting the housing downwardly to cam the contacts.

5 Claims, 6 Drawing Figures

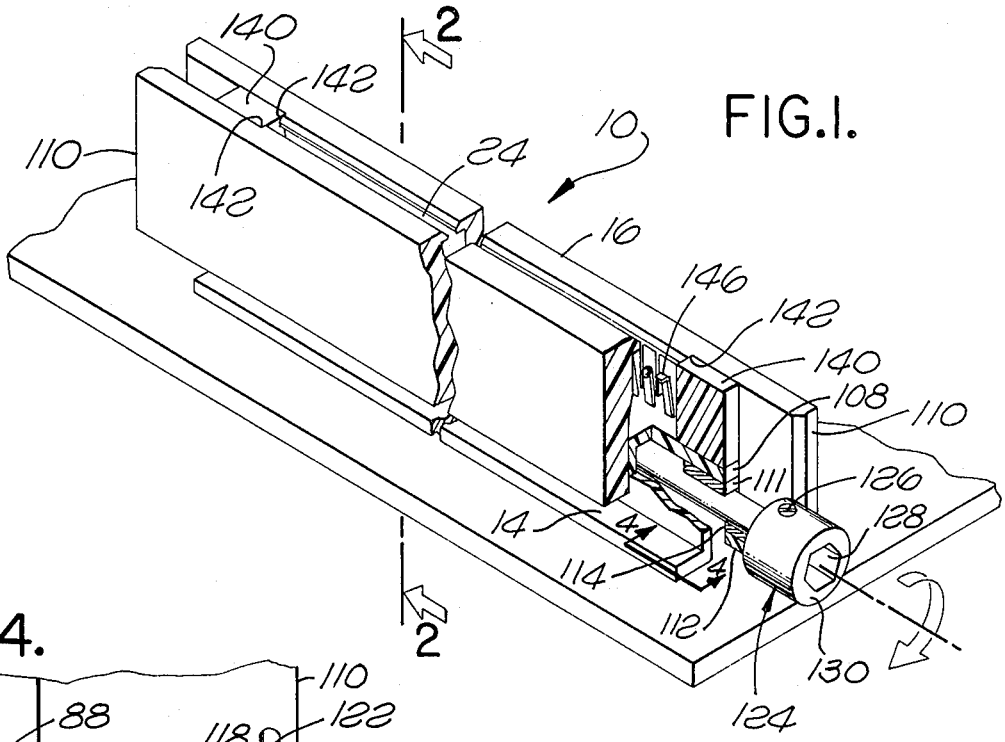
FIG.1.
FIG.4.
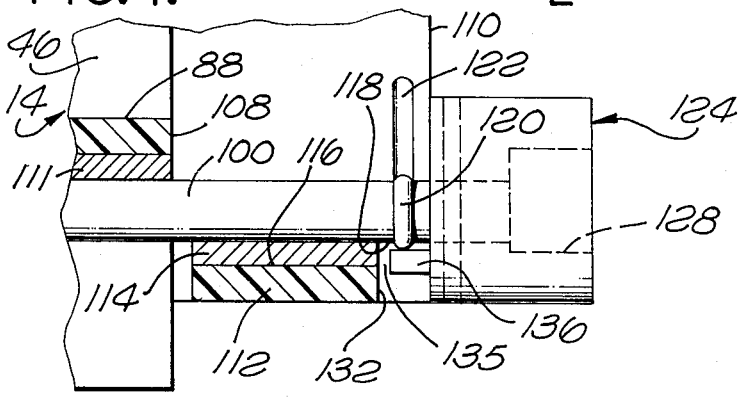
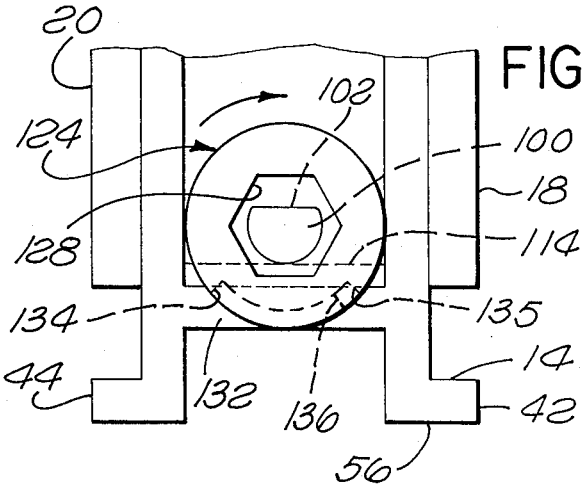
FIG.5.
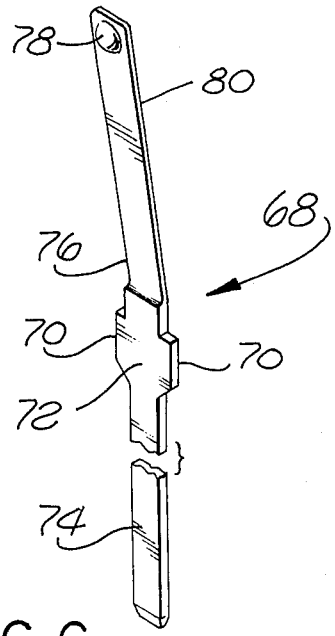
FIG.6.

ZERO FORCE PRINTED CIRCUIT BOARD CONNECTOR

BACKGROUND OF THE INVENTION

This invention relates generally to a printed circuit board connector and, more particularly, to a zero insertion force printed circuit board connector having cam means therein for actuating the contacts into engagement with the pads along the edge of a printed circuit board.

It is well known in the art that substantial force is required to insert a printed circuit board into a connector having a large number of spring contacts therein due to the resilient engaging force of the contacts with the edge of the board. As the number of contacts is increased in a connector, the amount of force required to insert the printed circuit board into the connector, or to withdraw it from the connector, may become excessive for practical use. In addition, the direct insertion of boards into connectors having spring contacts therein results in a wiping action occurring between the contacts and the pads on the edge of the board, which causes excessive wear of the pads over lengthy periods of use of the connector. It is therefore a common practice in the art to provide a zero insertion force printed circuit board connector in which the contacts are mounted so that they are out of the path of movement of the board when it is inserted into the connector whereby no resistance is encountered upon inserting the board thereinto. Thereafter the contacta are cam actuated into engagement with the pads on the edge of the board. When it is desired to remove the board from the connector, the cam actuation mechanism is released, so that the contacts are no longer frictionally engaging the pads on the board, thus allowing the board to be freely removed from the connector. U.S. Pat. No. 3,526,869 discloses a zero force printed circuit board connector in which a rotatable cam pushes a longitudinally movable slide cam element that cams the contacts into engagement with the pads on a printed circuit board inserted into the connector. U.S. Pat. No. 3,478,301 discloses a zero force printed circuit board connector in which the board actuates cam blocks in the connector which in turn cam the contacts into engagement with the board when the board is inserted into the connector. It is also known in the art to provide a zero force printed circuit board connector in which a movable cam on the connector housing acts directly upon the contacts to actuate them. Examples of these connectors are found in the following U.S. Pat. Nos. 3,475,717; 3,329,926; and 3,568,134. U.S. Pat. No. 2,857,577 discloses a zero force connector in which a housing is frictionally mounted downwardly over contacts secured in a substrate. Sliding downward motion of the housing cams the contacts into engagement with the printed circuit board inserted in the housing. *IBM Technical Disclosure Bulletin* entitled, "Low Voltage Pluggable Connector", by C. B. Hill et al., Vol. 8, No. 12, May 1966, discloses a zero force connector similar to that disclosed in the aforementioned Pat. No. 2,857,577 in which the housing is moved over the contacts to cam them by means of screws which extend upwardly through the substrate and are threadedly received in holes in the bottom of the housing. Such an arrangement requires at least four screws, one at each corner of the connector housing, to assure that the housing is firmly and uniformly seated on the substrate so that a uniform camming force is applied to the contacts urging them into engagement with the pads on a printed circuit board mounted in the housing. The use of a number of screws to mount the housing over the contacts is obviously time consuming. Moreover, it is frequently very inconvenient, if not impossible, to actuate screws from the bottom of a mounting substrate for a connector housing in an electronic packaging assembly.

It is the purpose of the present invention to provide a zero force printed circuit board connector of the general type disclosed in the aforementioned IBM bulletin with a cam actuating mechanism which moves the housing in a uniform, controlled manner over the contacts to simultaneously and uniformly cam the contacts into engagement with a printed circuit board mounted within the connector housing. It is also a purpose of the invention to provide such a connector in which the cam actuating mechanism is mounted in a position where it is easily accessible for operation by the user, and allows actuation of the housing with only a single simple motion, thus overcoming the disadvantages of the aforementioned IBM connector.

SUMMARY OF THE INVENTION

According to the principal aspect of the present invention, there is provided a zero force printed circuit board connector in which resilient contacts, preferably arranged in two opposed rows, are mounted in a mounting member. The contacts have upper contacting portions for engaging the pads on a printed circuit board mounted in the connector and intermediate regions which in each row are inclined upwardly toward each other A hollow insulative housing is movably mounted over the contacts, and has an elongated slot in its upper wall for receiving a printed circuit board. The contacting portions of the contacts are normally arranged out of the path of the slot so that when a printed circuit board is inserted into the slot, the contacts will not engage the intermediate regions of the two rows of contacts. When the housing is shifted toward the mounting member, the cam surfaces thereof which engage the intermediate regions of the contacts shift the contacts in the respective rows toward each other for engagement with the conductive pads on the board inserted into the connector housing. An elongated movable cam extends lengthwise of the housing. Actuation of the cam moves the housing downwardly toward the mounting member to shift the contacts in the manner just described. Movement of the housing by the cam is uniform and controlled thereby producing a uniform camming action against the contacts so that they will simultaneously engage the pads on the board mounted on the connector housing with a predetermined, controlled force. The cam has an actuation means adjacent to one end of the housing which is easily accessible to the user for actuating the cam and thus effecting electrical engagement between the contacts in the connector housing and the printed circuit board mounted therein.

Other aspects and advantages of the invention will become more apparent in view of the accompanying drawings taken in connection with the following description.

BRIEF DESCRIPTION OF THE DRAWINGS

FIG. 1 is a perspective view of the connector of the present invention shown mounted on a planar substrate, with portions of the connector housing broken away to show the interior structure thereof;

FIG. 4 is a fragmentary side elevational view taken in the direction of arrows 4—4 in FIG. 1;

FIG. 5 is a fragmentary end view of the connector; and

FIG. 6 is a perspective view of one of the signal contacts employed in the connector.

DESCRIPTION OF THE PREFERRED EMBODIMENT

Figure 2:
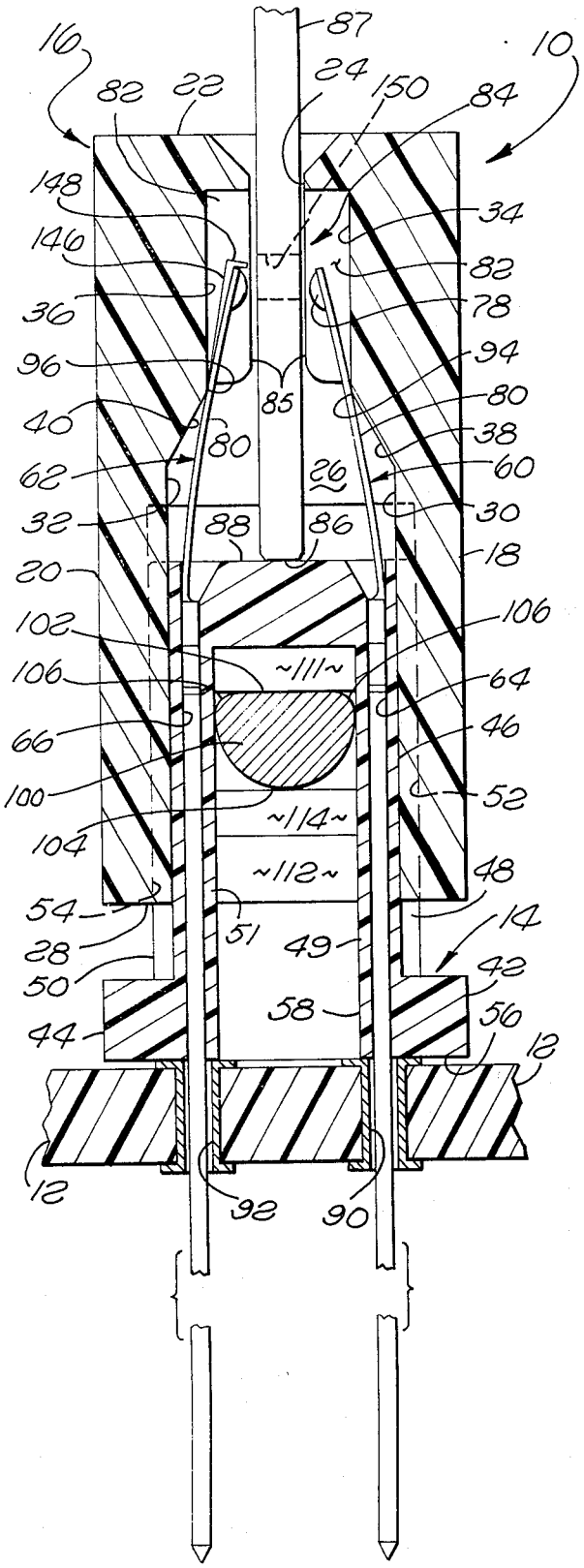
FIG. 2 is an enlarged vertical sectional view taken along line 2—2 of FIG. 1 showing the connector in its unactuated position.

Referring now to the drawings in detail, the zero insertion force printed circuit board connector of the present invention, generally designated 10, is shown as being mounted on a planar substrate 12, which may be a printed circuit board. The connector comprises two parts, namely, an elongated insulative mounting member 14 and an elongated hollow insulative housing 16.

The housing 16 has a pair of spaced sidewalls 18 and 20 and an upper wall 22. An elongated printed circuit board receiving slot 24 is formed in the upper wall 22. The spaced sidewalls 18 and 20 define an elongated recess 26 within the housing 16 which opens at the bottom 28 of the housing. The recess 26 is defined in part by lower vertical inner surfaces 30 and 32 of the walls 18 and 20, respectively. The upper portion of the recess 26 is defined by vertical surfaces 34 and 36 which are spaced apart a distance less than the spacing between the surfaces 30 and 32. A tapered ramp 38 joins the surface 30 to the surface 34. A tapered ramp 40 on the opposite side of the connector housing joins the surface 32 to the surface 36.

The mounting member 14 embodies a pair of outwardly extending side flanges 42 and 44 and an upstanding longitudinally extending hollow section 46 which is slidable vertically within the recess 26 in housing 16. Outwardly and vertically extending tongues 48 and 50 are formed on the opposite sides 49 and 51, respectively, of the hollow section 46 of mounting member 14. Preferably, these tongues are provided in at least two longitudinally spaced locations on the mounting member. Only one pair of such tongues is shown in the drawings. The tongues 48 and 50 slidably engage mating grooves 52 and 54 formed in the vertical surfaces 30 and 32, respectively, of housing 16. This tongue-and-groove arrangement assures proper longitudinal positioning of the connector housing with respect to the mounting member 14, and also provides a uniform, controlled sliding interconnection between the two parts.

The hollow section 46 of the mounting member 14 defines a longitudinally extending passage 58. Two rows of contacts 60 and 62 are mounted in the mounting member 14. The row of contacts 60 is mounted in vertically extending slots 64 in the side 49 of the mounting member while the row of contacts 62 is mounted in vertically extending slots 66 in the side 51.

Reference is made to FIG. 6, which shows one of the contacts used in the connector, generally designated 68. It is to be understood that the contacts in the respective rows of contacts 60 and 62 are identical and the following description with respect to contact 68 applies to the contacts in each row. The contact 68 has a pair of outwardly extending shoulders 70 forming a rigid mounting section 72 which has an interference fit with the sides of the slot, either 64 or 66, in which the contact is mounted. The lower end 74 of the contact is preferably in the form of a wire-wrap tail, having a rectangular cross-section, as shown. Alternatively, the tail may have a square cross-section. The section 76 of the contact 68 above the mounting portion 72 is coined to a reduced thickness so that the upper section is resilient in the lateral direction, that is, in the direction toward the printed circuit board receiving slot 24. The contact has an upper contacting portion 78 preferably in the form of a protuberance which provides a high unit contact force with a pad on a printed circuit board with which the contact is engaged upon actuation of the connector. The thinner section 76 of the contact is inclined so that between the upper contacting portion 78 and the mounting portion 72 of the contact there is provided an inclined intermediate region 80.

As seen in FIG. 2, the intermediate regions 80 of the contacts in the two rows 60 and 62 are inclined upwardly toward each other in the direction of the slot 24. In the unactuated position of the connector as illustrated in FIG. 2, the upper contacting portions 78 of each pair of opposed contacts in the two rows 60 and 62 are spaced apart a distance greater than the width of the slot 24 in the housing 16 so that the contacts will not engage a printed circuit board means initially inserted through the slot into the connector.

Laterally extending walls 82 extend inwardly from the sidewalls of the connector housing, defining upper contact compartments 84 into which the upper regions of the contacts extend. Thus, the walls 82 separate the adjacent contacts in each row of contacts to prevent engagement therebetween. The walls 82 terminate in vertical inner edges 85 which are aligned with the sides of slot 24 in the housing. As a consequence, the edge of a printed circuit board, designated 87, may be moved downwardly through the slot 24, between the edges 85, until the lower end 86 of the board engages the top 88 of the mounting member 14. The top 88 functions as s stop controlling the extent to which the board 87 may be inserted into the connector.

It is noted that the lower ends 74 of the contacts in the two rows of contacts 60 and 62 extend below the bottom 56 of the mounting member 14. As illustrated in FIG. 2, the connector is mounted on a planar substrate 12. The substrate has two rows of plated-through holes 90 and 92 therein, each row being aligned with the rows of contacts 60 and 62. The lower wire-wrap tail sections 74 of the contacts in the two rows are press-fit into the pated-through holes 90 and 92 thereby providing an electrical and mechanical connection between the contacts and the holes. In addition, the contacts press fit into the holes in the substrate 12 mechanically securing the mounting member 14 upon the substrate. Alternatively, the mounting member 14 could be provided with a plurality of integral insulative hubs, not shown, extending downwardly from the bottom 56 thereof which may be frictionally retained in corresponding holes in a metal backpanel. In this case, the tails 74 of the contacts would extend downwardly through the hubs so as to be electrically isolated from the backpanel. It will be further appreciated that the connector 10 need not be mounted on either a printed circuit board or metal backpanel. For example, the lower ends of the contacts could be formed as solder or crimp pots for attachment to wires as in standard discrete electrical connectors.

Figure 3:
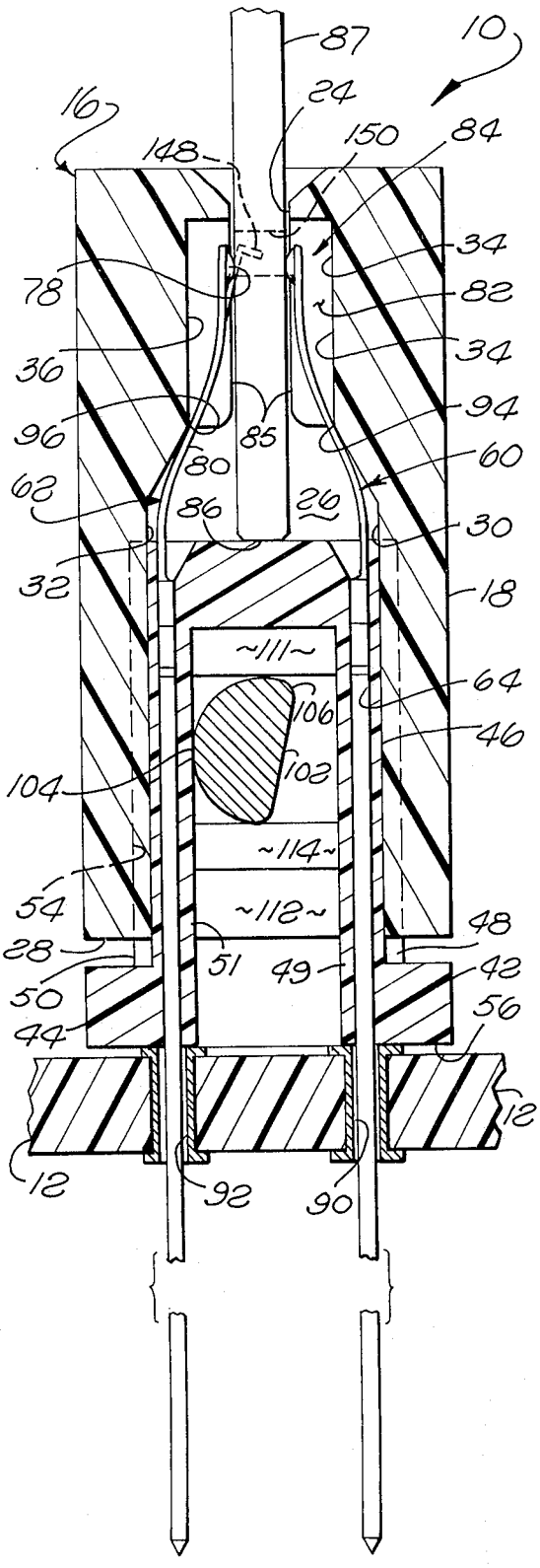
FIG. 3 is a vertical sectional view of the connector similar to FIG. 2 but showing the connector in its actuated position.

It is noted that an angular surface 94 is provided where the ramp 38 on sidewall 18 joins the vertical surface 34. The surface 94 engages the inermediate regions 80 of the row of contacts 60. A like surface 96 is formed on the opposing sidewall 20 engaging the intermediate regions of the row of contacts 62. Such surfaces 94 and 06 constitute cam surfaces for actuating the contacts. When the connector housing is in the position illustrated in FIG. 2, the cam surfaces 94 and 96 are located sufficiently high on the contacts that the contacting portions 78 of the contacts do not extend into the printed circuit board receiving slot 24. Consequently, the printed circuit board 87 may be mounted through the slot into the connector without any resistance. In order to actuate the contacts to bring the upper contacting portions 78 into engagement with the conductive pads, not shown, on the opposite sides of the board 87, it is necessary that the housing 16 be moved toward the mounting member 14, that is, in the downward direction if the mounting member is fixed as illustrated and described herein. As seen in FIG. 3, downward motion of the housing as just described will cause the cam surfaces 94 and 96 to act upon the intermediate inclined regions 80 of the contacts, urging the contacts in the two rows 60 and 62 toward each other thereby causing the upper contacting portions 78 of the contacts to engage the pads on the opposite sides of the board 87. The contacts will engage the pads with a high unit force and with a slight wiping action, thereby assuring good electrical engagement therebetween. A cam mechanism is provided for moving the housing and mounting member relative to each other to the position illustrated in FIG. 3 to actuate the contacts. Such cam mechanism will cause such relative movement between the two connector parts even if the mounting member 14 is not fixed to a substrate.

The cam mechanism comprises an elongated rotatable cam shaft 100 which extends lengthwise through the passage 58 in the mounting member 14. The cam shaft has a relatively flat surface 102 on one side and an arcuate surface 104 on the opposite side. The two surfaces join each other at rounded edges 106. The ends 108 of the hollow section 46 of the mounting member are spaced inwardly with the respect to the ends 110 of the housing 16, as seen in FIG. 1. A phosphorus bronze cam bearing plate 111 is mounted under the top 88 of the mounting member 14 adjacent to each of the opposite ends 108 thereof. Laterally extending arms 112 join the sidewalls 18 and 20 of the housing 16 adjacent to the ends 110 of the housing, only one of such arms being visible in FIG. 1. Each arm 112 is spaced outwardly beyond the end 108 of the mounting member 14. A phosphorus bronze cam bearing plate 14 is mounted in a recess 116 opening to the upper surface 118 of each of the arms 112. When the connector is in its unactuated position, as illustrated in FIG. 2, the flat surface 102 of the cam shaft 100 is positioned upwardly and engages the lower surface of the bearing 111, and the arcuate surface 104 of the cam shaft is disposed downwardly and engages the upward surface of bearing 114. The laterally extending arms 112 on the opposite ends of the connector housing, and the bearings 114 supported thereon, are spaced longitudinally apart a distance greater than the distance between the ends 108 of the mounting member 14. As a consequence, the housing may be slidably mounted downwardly over the mounting member when the cam shaft is not mounted therein. After the housing is mounted over the mounting member, the cam shaft is then pushed longitudinally through the opening defined between the bearings 111 and 114. Thus, it will be seen that the cam shaft serves to interconnect the two parts of the connector together.

Preferably, the cam shaft is formed with an annular raised rib 120 which snaps into cooperating grooves 122 on the vertical surfaces 30 and 32 of sidewalls 18 and 20, only one of such grooves 122 being visible in FIG. 4. The rib cooperates with the grooves 122 to secure the cam shaft longitudinally in the connector.

An actuating head 124 is provided on the end of the cam shaft 100. The head extends outwardly beyond the end 110 of housing 116 so that it is readily accessible. The actuating head is fixed to the cam shaft by means of a screw 126. A hexagonal-shaped aperture 128 opens at the front 130 of the actuating head 124 for receiving a suitable tool for rotating the actuating head and hence the cam shaft 100. In order to actuate the contacts, it is necessary to rotate the cam shaft 100 approximately 90° which causes the housing 16 to be shifted downwardly over the mounting member, thereby causing the cam surfaces 94 and 96 to act upon the intermediate inclined regions 80 of the contacts urging the contacts into engaging position as seen in FIG. 3. Preferably, the cam shaft is rotated 100°, or slightly over center, so that there will be no tendency for the cam shaft to shift back to the position illustrated in FIG. 2, deactivating the contacts. In addition, it is desirable to provide a stop means controlling the extent of rotation of the cam shaft between defined limits. To this end, a forwardly opening arcuate groove 132 is formed in the outer end of arm 112 adjacent to one end 110 of the connector housing. The groove extends over a 100° arc, as best seen in FIG. 5. The ends 134 and 135 of the groove define stop surfaces. The actuating head 124 of the cam shaft 100 has a forwardly extending finger 136 which extends into the groove 132. Thus, the head 124 can be rotated over an arc 100°, and is limited against any additional rotation by the ends 134 and 135 of slot 132.

When the actuating head 124 of the cam shaft 100 is positioned with its stop finger 136 adjacent to the end 135 of the groove 132, as seen in FIG. 5, the cam shaft is disposed with its flat surface 102 facing upwardly so that the connector is in its unactuated position, as seen in FIG. 2. To actuate the connector, the head 124 is rotated in the clockwise direction as indicated by the arrows in FIGS. 1 and 5, until the stop finger 136 engages the opposite end surface 134 of the groove 132. In this position of the head 124, the cam shaft will be disposed as shown in FIG. 3. During rotation of the cam shaft between the two positions just described, the cam surfaces 94 and 96 on the housing 16 force the two rows of contacts inwardly into engagement with the sides of the printed circuit board 84.

When it is desired to inactivate the connector, the cam shaft is rotated from the position shown in FIG. 3 back to that shown in FIG. 2. The inherent resilient force of the spring contacts will tend to raise the housing 116 upwardly on the mounting member 14 when the cam shaft is rotated to its inactive position. If the spring force is inadequate, the housing may be raised manually to fully inactivate the contacts. Alternatively, a leaf spring or other spring device, not shown, could be provided, as for example between the flanges 42 and 44 on the mounting member 14 and the bottom 28 of the housing 16, to bias the housing upwardly.

From the foregoing it is seen that by the present invention there is provided a cam shaft 100 which extends through the connector housing 12 and mounting member 14, serving to interconnect these two parts together, and causing the two parts to be moved relatively toward each other, when the cam shaft is rotated, to simultaneously cam actuate the two rows of contacts in the connector into engagement with the opposite sides of a printed circuit board positioned therein. Due to the mounting arrangement of the cam shaft relative to the bearing plates 110 and 114 at opposite ends of the connector, and the tongue-and-groove sliding connection between the connector housing and the mounting member, the housing member is moved upon rotation of the cam shaft in a smooth, uniform, controlled manner, providing consistent cam action and spring loading of the contacts against the printed circuit board inserted into the connector.

Preferably, removable snap-in end guide members 140 are provided in the opposite ends of the connector housing 16. The end guide members are properly positioned in the housing by abutting against vertical shoulders 142 on the inner surfaces of the sidewalls of the housing. The members 140 provide guides for vertical insertion of the printed circuit board 84 into the slot 24 in the connector housing. The end guide at either end of the connector housing may be removed, thus permitting the printed circuit board 84 to be slidably inserted in the longitudinal direction into the slot 24 in the housing rather than from the top of the housing as is the conventional practice in the art. The board may be slid into the housing 16 from the end because the cam actuating mechanism is disposed below the top 88 of the mounting member 14 and thus will not interfere with the end-insertion of the board. Since the board may be inserted into the housing from the end, it will be appreciated that less space is required above the connector than in the case when the board must be inserted from the top. Because of this feature, and also because the actuating head 124 for the cam is disposed at the end of the connector housing, a large number of connectors may be mounted in close side-by-side relationship upon the planar substrate 12 and only a minimum amount of space is required above the connector for insertion of the board, thus leading to a very compact electronic packaging assembly.

Another feature of the invention is the provision of means for positively locking the printed circuit board 87 within the housing 16 when the contacts are actuated by the cam 100. To this end, there is provided at least two latch contacts 146 in the connector, preferably one on each end of the connector and on opposite sides of the slot 24. One such latch contact can be seen in FIG. 1 and the other in FIG. 2. The latch contacts are identical and are similar to the signal contacts 68 in the connector. Each latch contact differs from the signal contact 68 in that it does not have the contacting protuberance 78, but rather an inwardly extending latch finger 148. The printed circuit board 87 is formed with a pair of holes 150, only one being seen in FIGS. 2 and 3, which are aligned with the latch fingers 148 when the board is fully mounted in the connector housing. When the cam shaft is actuated, the latch contacts 146 on opposite sides of the connector are forced inwardly by the cam surfaces 94 and 96 on the housing 16, shifting the latch fingers on the contacts into the holes 150, as seen in FIG. 3. Hence, so long as the contacts are actuated by the cam shaft 100, the board 87 cannot be removed from the connector 10 since the latch fingers 148 will prevent such removal. When the cam shaft is rotated to its inactive position, the latch contacts 146 together with the signal contacts 68 will return to their inactive position as seen in FIG. 2, thus allowing the board 87 to be freely removed from the connector.

We claim:

1. A printed circuit board connector comprising:

an elongated mounting member having a generally flat lower surface adapted to be mounted on a planar substrate having holes therein;

two rows of resilient contacts, each contact having a lower mounting portion, an upper contacting portion and an inclined intermediate region between said upper and lower portions, the mounting portions of said contacts in each row being mounted in said mounting member, the intermediate regions of said two rows of contacts being inclined toward each other;

each said contact having a lower end below said mounting portion thereof, said lower ends of said contacts extending below said lower surface of said mounting member and being adapted to extend into said holes;

an elongated hollow insulative housing movably mounted over said contacts and having sidewalls slidably engaging the sides of said mounting member, said housing having a printed circuit board receiving slot therein overlying the area between said two rows of contacts;

said housing having cam surface means thereon engaging said intermediate regions of said contacts, said cam surface means shifting said upper portions of said contacts transversely toward a vertical plane passing through said slot upon relative movement of said housing toward said mounting member; and elongated rotatable cam means in said mounting member extending lengthwise between said two rows of contacts and above said lower surface, said cam means cooperating with said housing so that upon rotation of said cam means said housing and mounting member are slidably moved toward each other to shift said contacts, said cam means having actuation means adjacent to one end of said housing.

2. A printed circuit board connector as set forth in claim 1 wherein:

said rotatable cam means connects said housing to said mounting member.

3. A printed circuit board connector as set forth in claim 1 wherein:

said rotatable cam means comprises an elongated shaft extending lengthwise through both said housing and said mounting member.

4. A printed circuit board connector as set forth in claim 3 wherein:

said mounting member has a longitudinally extending passage therethrough;

said housing has means defining a pair of upwardly facing surfaces thereon each at the opposite ends of said mounting member, said upwardly facing surfaces being located below the top of said passage and above said lower surface; and said cam shaft extends through said passage along said top thereof with the ends thereof engaging said upwardly facing surfaces whereby said cam shaft retains said housing on said mounting member.

5. A printed circuit board connector as set forth in claim 1 including:

at least one latching contact mounted in said mounting member having a latching finger thereon extending laterally toward said plane and positioned to engage a mating opening in a printed circuit board positioned in said slot to retain said board therein, said latching contact having an inclined intermediate region engageable by said cam surface means to shift said latching finger toward said plane upon actuation of said cam means.

* * * * *